United States Patent [19]

Johnston et al.

[11] 4,282,414

[45] Aug. 4, 1981

[54] CONVERTIBLE SWITCH OPERATOR

[75] Inventors: Robert J. Johnston, Patterson Hts.; Stephen G. Layciak; George M. Cametti, both of Beaver, all of Pa.

[73] Assignee: Westinghouse Electric Corp., Pittsburgh, Pa.

[21] Appl. No.: 70,958

[22] Filed: Aug. 30, 1979

[51] Int. Cl.[3] ..... H01N 13/56; H01H 15/00

[52] U.S. Cl. ..... 200/160; 200/243; 200/307; 200/340; 200/16 A; 200/16 B

[58] Field of Search ..... 200/243, 160, 161, 307, 200/340, 16 R, 16 A, 16 B, 16 C, 159 R

[56] References Cited

U.S. PATENT DOCUMENTS

| | | | |
|---|---|---|---|
| 1,961,419 | 6/1934 | Hengst | 200/159 R |
| 2,335,283 | 11/1943 | Johnson | 200/16 A |
| 2,441,888 | 5/1948 | Lansing | 200/16 A |
| 2,489,185 | 11/1949 | Johnson | 200/16 A |
| 2,747,034 | 5/1956 | Machon et al. | 200/243 |
| 2,748,210 | 5/1956 | Frank | 200/243 |
| 2,916,673 | 12/1959 | Maslin et al. | 317/99 |
| 3,109,075 | 10/1963 | Ratcliff | 200/52 |
| 3,165,611 | 1/1965 | Hagberg | 200/159 R |
| 3,215,806 | 11/1965 | Arnold et al. | 200/159 R |
| 3,222,485 | 12/1965 | Hardesty et al. | 200/161 |
| 3,249,726 | 5/1966 | Long | 200/159 R |
| 3,551,614 | 12/1970 | Babler | 200/16 A |
| 3,626,171 | 12/1971 | Abramowitz | 200/159 R |
| 3,726,264 | 4/1973 | Lariviere | 200/161 |
| 3,937,913 | 2/1976 | Soulas et al. | 200/302 |

FOREIGN PATENT DOCUMENTS

| | | | |
|---|---|---|---|
| 676420 | 5/1939 | Fed. Rep. of Germany | 200/16 A |

*Primary Examiner*—Willis Little

*Attorney, Agent, or Firm*—L. P. Johns

[57] ABSTRACT

A convertible switch operator for use as a pull momentary and as a push-pull momentary operation characterized by a tubular selector longitudinally movable in a housing and spring biased by a first spring for operation as a pull operator; and spring biased by two springs in an intermediate position as a push-pull operator.

4 Claims, 11 Drawing Figures

CONVERTIBLE SWITCH OPERATOR

CROSS-REFERENCE TO RELATED APPLICATIONS

This application is related to the copending applications of R. J. Johnson, Ser. No. 45,448, filed June 4, 1979; Ser. No. 45,449, filed June 4, 1979; Ser. No. 858,323, filed Dec. 7, 1977; Ser. No. 25,178, filed Mar. 29, 1979; and Ser. No. 858,325, filed Dec. 7, 1977.

BACKGROUND OF THE INVENTION

1. Field of the Invention

This invention relates generally to electric control switches, and more particularly, it pertains to a switch operator therefor.

2. Description of the Prior Art

Prior selector switches of some types have been used for varying contact operating modes for which purpose they are provided with different operating parts for different modes of operation. An example of a control switch operator is disclosed in U.S. Pat. No. 3,169,406, issued Feb. 16, 1965, to J. H. Mullen. Some switch units, for example, comprise a single contact arrangement which is convertible from a two- to a three-mode unit. Disadvantages of some convertible switches have included complicated parts and/or methods for changing parts.

SUMMARY OF THE INVENTION

In accordance with this invention a convertible switch operator is provided for use by conversion as a pull momentary and a push-pull momentary operation, comprising separable switch contacts, a contact operating member for moving the contacts between open and closed positions, a housing, an actuator within the housing and movable longitudinally between first and second positions for reciprocally moving the member, first stop means within the housing for limiting the movement of the actuator beyond the first position, first spring means for holding the actuator in the first position against said stop means, whereby the actuator may be pulled manually to the second position against the bias of the spring; means for converting the operator to a push-pull operation and comprising second spring means for holding the actuator in an intermediate position in combination with the first spring means, and comprising a guide between the housing and the actuator, the guide having an inturned flange, the actuator having an outturned flange aligned with the inturned flange when the actuator is disposed in the intermediate position, the converting means also comprising a pair of slides, one slide on each side of the aligned flanges, the first spring means extending between the first stop means and the slide nearest to said first stop means, the second spring means extending between the housing and the slide nearest to said first stop means, whereby the spring means in corresponding slides cooperate to maintain the inturned and outturned flanges in alignment, and whereby the actuator may be pushed or pulled between the first and second positions.

The advantage of the convertible switch operator of this invention is that it is readily adapted for use as a pull momentary or a push-pull momentary operator.

DESCRIPTION OF THE PREFERRED EMBODIMENTS

Figure 1:
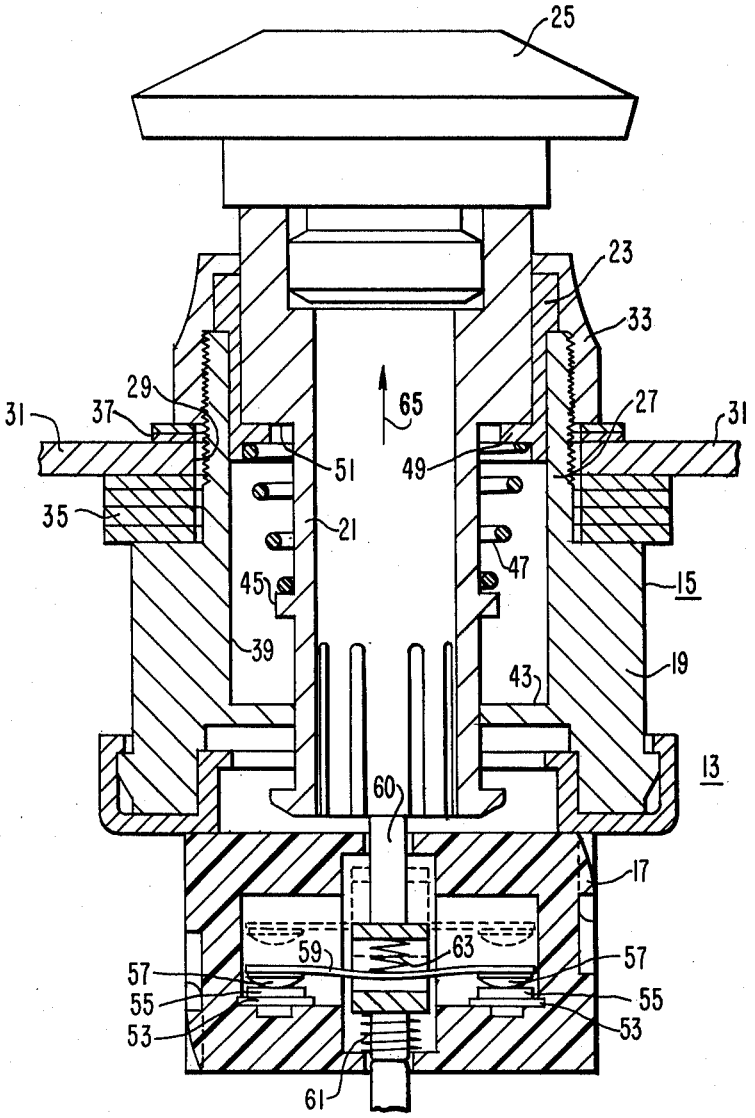
FIG. 1 is a vertical sectional view through a convertible switch operator for use as a pull momentary device.

In FIG. 1 a switch is generally indicated at 13 and it comprises a switch operator 15 and a contact block 17. The switch operator 15 comprises a housing 19, an actuator 21, a bushing 23, and a button 25. The housing 19 is tubular and has a reduced upper portion 27 which extends through an opening 29 in a panel 31. A clamp ring 33 is threadably mounted at the upper end portion of the housing 19 for clamping the panel 31 between gaskets 35 and thrust washers 37.

The actuator 21, which is preferably tubular, is mounted for linear movement within a bore 39 of the tubular housing 19 where it is maintained in place by the bushing 23 and an annular flange 43. The actuator 21 comprises a peripheral flange 45 on which the lower end of a coil spring 47 is disposed. The upper end of the spring 47 abuts an inturned flange 49. The actuator also comprises an annular shoulder 51 which is held against the inturned flange 49 by the spring 47.

The contact block or switch 17 comprises a pair of stationary terminal structures 53 with contacts 55 and a pair of movable contacts 57 supported by a movable contact operating member including a contact carrying bridge 59 and a plunger 60. The plunger 60 engages the lower end of the actuator 21. A coil spring 61 holds the contacts in the open position with the upper end of the plunger 60 against the lower end of the actuator. The movable contact carrier also comprises an override spring 63 for holding the contacts 55, 57 tightly in place when the contacts are closed.

When the actuator button 25 is pulled in the direction of the arrow 65, the plunger 60 opens the contacts 55, 57 as shown in the broken-line position. Upon release of the button 25 the spring 47 returns the actuator 21 and the movable contacts 57 to the solid-line positions shown. Although a normally open switch 17 is shown in FIG. 1, a normally closed switch may be provided in the alternative or in addition.

Figure 2:
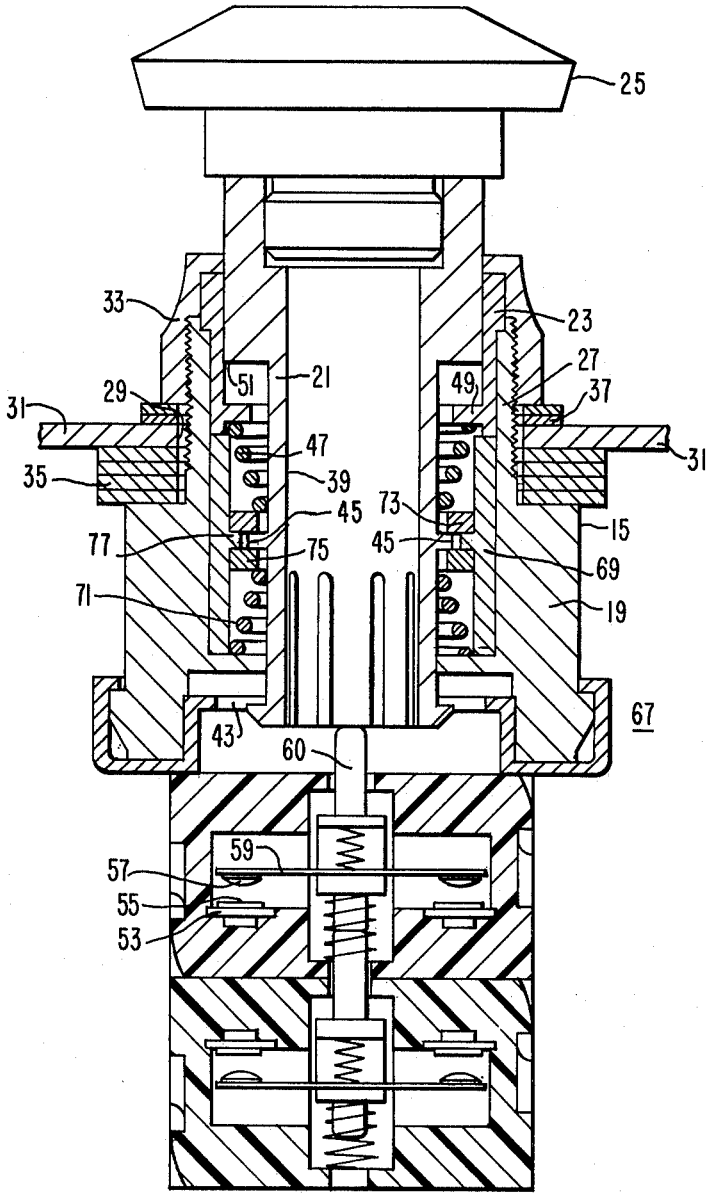
FIG. 2 is a vertical sectional view showing the operator with additional parts for use as a push-pull device.
Figure 4:
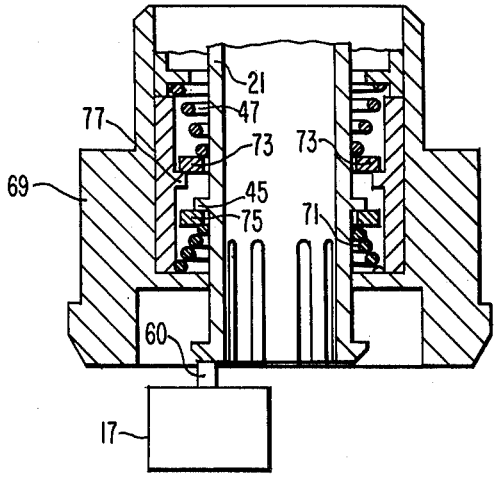
FIG. 4 is a view similar to FIG. 3 showing the device in the pushed position.
Figure 5:
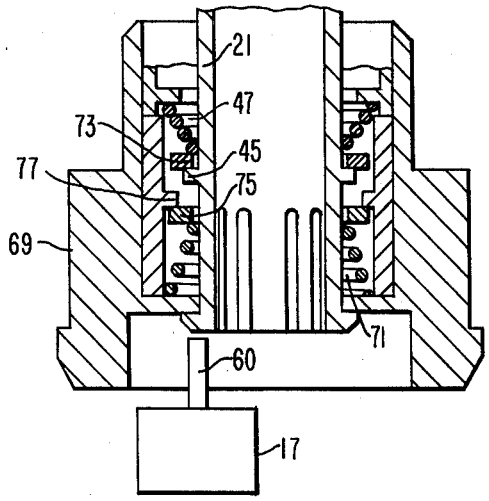
FIG. 5 is a view similar to FIG. 3 showing the device in the pulled position.

In FIG. 2 a push-pull momentary switch is generally indicated at 67. Inasmuch as it includes parts corresponding to those shown in the switch of FIG. 1, those parts are identified with corresponding reference numbers. As a push-pull operator the switch operator 15 comprises additional parts including a guide 69, a second spring 71, and a pair of slides or collars 73, 75. The guide 69 is a tubular member having an inturned flange 77. As shown more particularly in FIGS. 3, 4 and 5, the collars 73, 75 are disposed above and below the flanges 45, 77 respectively.

Figure 3:
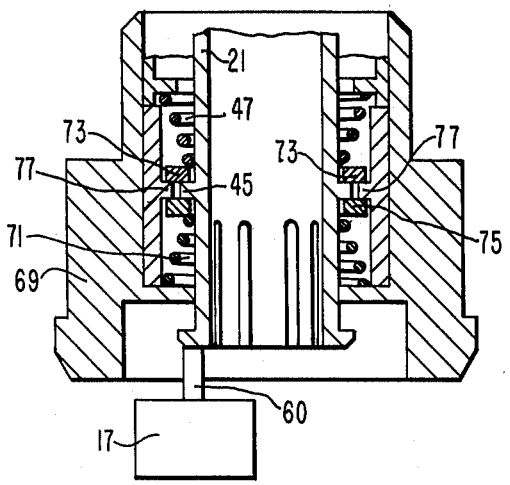
FIG. 3 is an enlarged fragmentary sectional view showing the operator in the normal position as a push-pull device.
Figure 7:
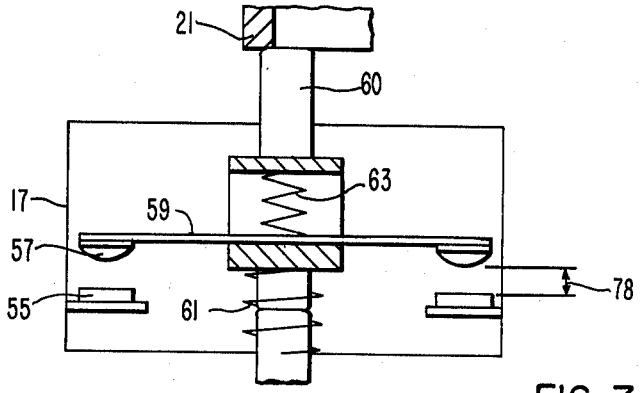
Figure 10:
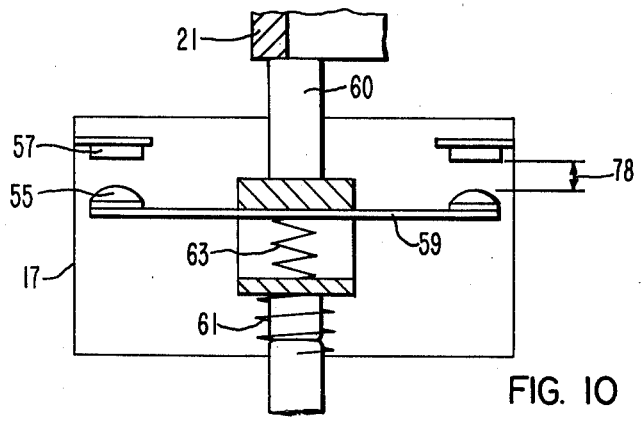

In the normal position (FIG. 3) of the switch operator 15, the pressure of the springs 47, 71 bearing against the collars 73, 75 retain the flanges 45, 77 in alignment. As a result, the plunger 60 of the switch 17 is retained in an intermediate or middle position (FIG. 3). Accordingly, a gap 78 is maintained between the contacts 55, 57 whether the contact block 17 is normally open (FIG. 7), or normally closed (FIG. 10).

Figure 6:
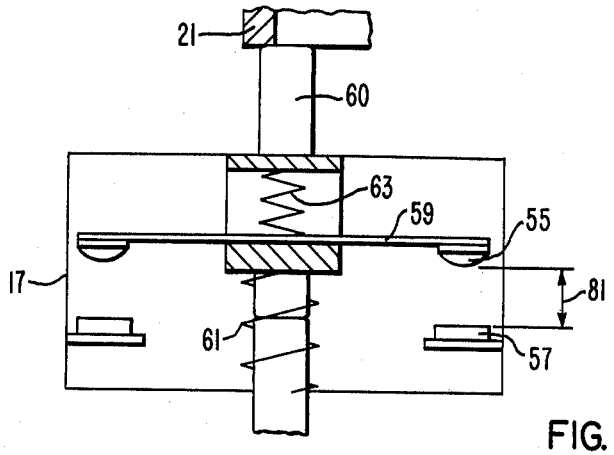
FIGS. 6, 7, and 8 are schematic views of a normally open switch block in the pulled, normal, and pushed positions.
Figure 8:
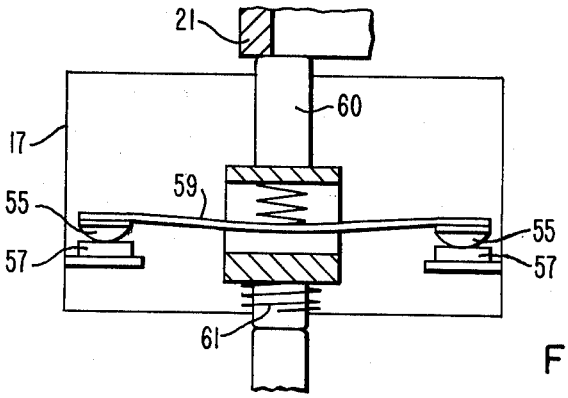
Figure 9:
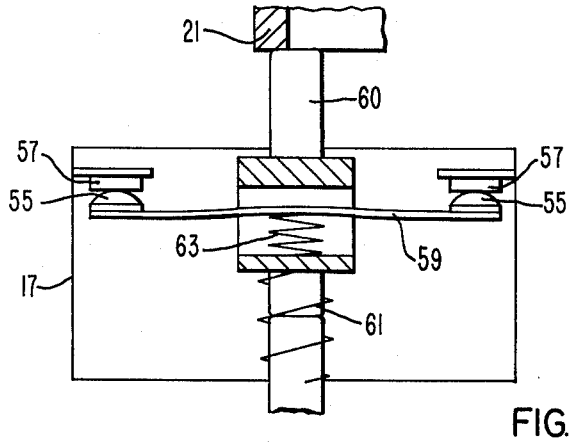
FIGS. 9, 10, and 11 are schematic views of a normally closed switch block in the pulled, normal, and pushed positions.
Figure 11:
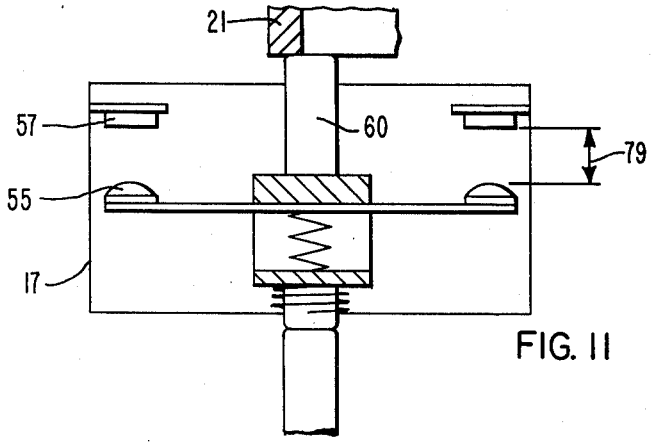

In operation, when the button 25 is pushed, the flange 45 (FIG. 4) depresses the collar 75 against the spring 71 and actuator 21 pushes the plunger 60 down to close the contacts 55, 57. Where the contact block 17 is normally open (FIG. 8), the contacts 55, 77 are closed against the pressure of the spring 61. On the other hand, where the contact block 17 is normally closed (FIG. 11), the contacts 55, 57 are open to a full gap as indicated by an arrow 79.

Where the button 25 (FIG. 2) is pulled outwardly the flange 45 (FIG. 5), bearing agianst the collar 73, compresses the spring 47 and the plunger 60 of the contact block 17 rises to the uppermost position. Where the contact block 17 is normally open (FIG. 6) the spring 61 opens the contacts 55, 57 to the fully open position is shown by the gap arrow 81. However, where the contact block 17 is normally closed (FIG. 9), the spring 61 moves the contacts 55, 57 to the closed contact position.

In conclusion, the convertible switch operator of this invention may be used either for a pull momentary operation or a push-pull momentary operation depending upon the particular assembly of parts in the operator. Finally, inasmuch as the actuator is tubular, the outer end of the button may be illuminated by installation of a light in the tube in the manner similar to that shown in the prior art.

What is claimed is:

1. A convertible switch operator for use by conversion as a pull momentary and a push-pull momentary operation, comprising separable switch contacts, a contact operating member for moving the contacts between open and closed positions, a housing, an actuator within the housing and movable longitudinally between first and second positions for reciprocally moving the member, first stop means within the housing for limiting movement of the actuator beyond the first position, first spring means for holding the actuator in the first position against said stop means, whereby the actuator may be pulled manually to the second position against the bias of the spring, means for converting the operator to a push-pull operation and comprising second spring means for holding the actuator in an intermediate position in combination with the first spring means, the means for converting the operator also comprises a guide between the housing and the actuator, the guide having an inturned flange, the actuator having an outturned flange aligned with the inturned flange when the actuator is disposed in the intermediate position, whereby the actuator may be pushed or pulled between the first and second positions.

2. The operator of claim 1 in which the first stop means comprises an inturned flange extending radially inward of the housing.

3. The operator of claim 2 in which a bushing is mounted between the housing and the actuator and the inturned flange is part of the bushing.

4. The operator of claim 1 in which the converting means also comprises a pair of collars, one collar on each side of the aligned flanges, the first spring means extending between the first stop means and the collar nearest to the said first stop means, the second spring means extending between the housing and the collar nearest to said first stop means, whereby the spring means and corresponding collars cooperate to maintain the inturned and outturned flanges in alignment.

* * * * *